United States Patent [19]

Büttner

[11] 3,930,442

[45] Jan. 6, 1976

[54] MACHINE FOR THE TYING OF PACKAGES OR THE LIKE

[75] Inventor: Hans Hugo Büttner, Mettmann, Germany

[73] Assignee: Firma Buttner Kommanditgesellschaft Maschinenfabrik, Gruiten, Germany

[22] Filed: June 7, 1973

[21] Appl. No.: 367,813

[30] Foreign Application Priority Data

July 5, 1972 Germany ..... 2232894
Jan. 15, 1973 Germany ..... 2301792

[52] U.S. Cl. ..... 100/18; 100/7; 100/27; 53/198 R

[51] Int. Cl.[2] ..... B65B 13/10

[58] Field of Search..... 53/139.3, 198 R; 100/7, 100/33 PB, 17, 18, 19, 27, 14

[56] References Cited

UNITED STATES PATENTS

| | | | |
|---|---|---|---|
| 2,361,742 | 10/1944 | Bunn | 100/17 |
| 2,797,634 | 7/1957 | Rueckert | 100/27 X |
| 2,977,872 | 4/1961 | Allfree | 100/17 |
| 3,114,308 | 12/1963 | Saxton et al. | 100/7 X |
| 3,179,037 | 4/1965 | Cranston et al. | 100/7 X |
| 3,239,994 | 3/1966 | Etzel et al. | 53/139.3 |
| 3,521,550 | 7/1970 | Van Doorn et al. | 100/26 |

*Primary Examiner*—Billy J. Wilhite
*Attorney, Agent, or Firm*—Ernest G. Montague; Karl F. Ross; Herbert Dubno

[57] ABSTRACT

Apparatus for tying packages in which a stretch of a tying strand is spanned across a transport path, the package is entrained along this path to draw the strand around it lateral side, and a tying arm is swung across the remaining side of the package and cooperates with fastening means to anchor the strand about the perimeters of the package.

7 Claims, 12 Drawing Figures

FIG. 3
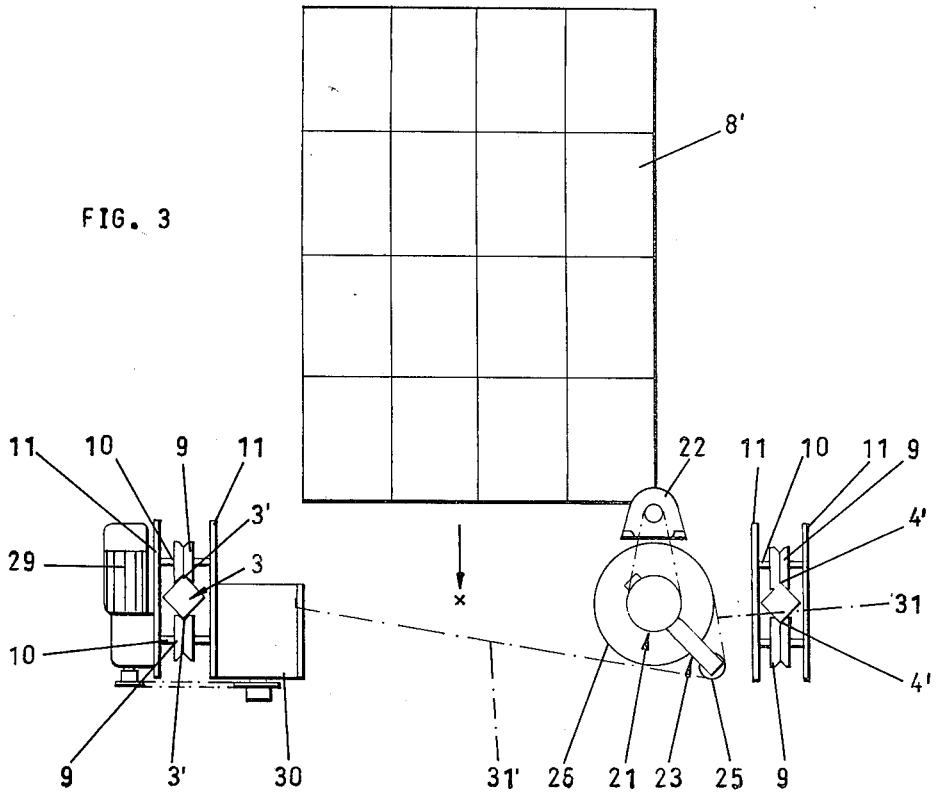
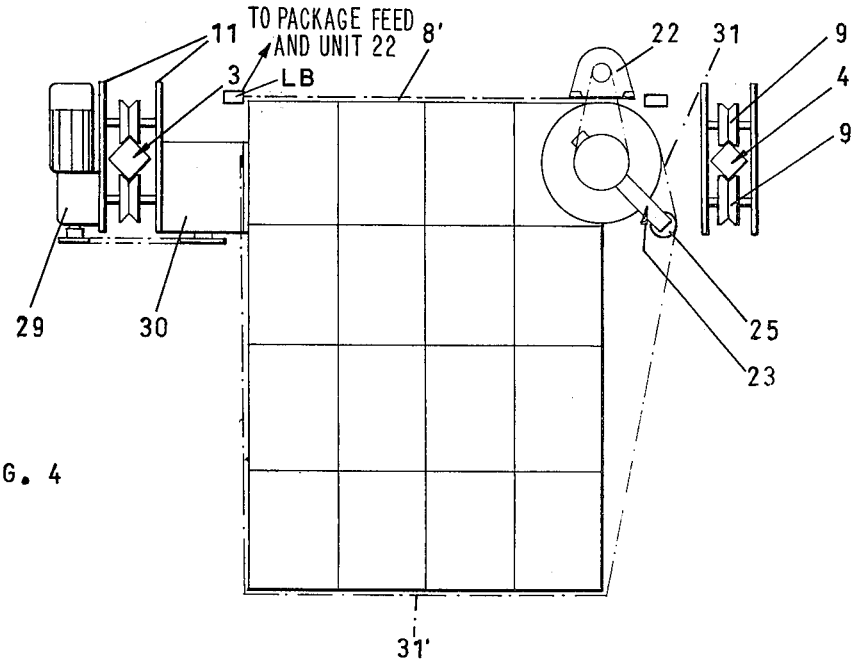
FIG. 4

MACHINE FOR THE TYING OF PACKAGES OR THE LIKE

The present invention relates to a machine for the tying of packages or the like having a feed path for the package and a tying arm which guides the strand and conducts it to the fastening device.

Such machines, as is known, have a tying arm which swings around a central shaft. The size of the package to be tied is in this connection dependent on the length of the tying arm. This means that the packages must lie within the path of movement of the guide roller at the end of the tying arm. Large packages therefore require machines of large dimensions. This means that expensive drive devices and braking devices must be provided, since larger masses must be placed in movement and braked suddenly.

It is one object of the present invention, to provide a machine of this type which is of simple construction and of, a small size with respect to the size of the packages.

It is another object of the present invention, to provide a machine of this type, wherein the placing of the tying means around the package is effected in part by the bulging out of a strand which is freely stretched transverse to the feed path between the fastening device and the tying arm upon the feed movement of the package and by the tying arm only in the remaining part.

Preferably the tying arm is arranged on a carriage which permits a lateral movement of the tying arm for its swinging movement and which travels on rails lying transverse to the feed path and extending over its width.

One advantageous feature of the present invention resides in that the feed drum for the tying element is arranged on the carriage, coaxial with the axis of swing of the tying arm. In one advantageous embodiment in accordance with the present invention, the carriage rails and the fastening device are vertically adjustable on vertical columns.

It is favorable in accordance with the present invention that the drum be rotatable with braking action in the direction of removal of the tying element.

Another advantageous embodiment in accordance with the present invention results from the fact that the vertical columns form with the carriage rails an introduction gate for the package.

One advantage from the standpoint of packaging technique consists in accordance with the present invention in, that the swinging movements of the tying arm extend over the rear corner angles of the package In this connection, it is favorable for the lateral movement of the tying arm to occur between the two phases of swing.

This solution is provided by a machine of this type, in which the package itself also contributes to the tying, so that the wrapping of the tying means around the package is effected on the one hand by the package and on the other hand by the tying arm. Since the package strikes against the freely streched cord between the tying arm and the fastening device and thereby bulges the cord out upon its feed movement, the package may be of any desired length. During the feed movement, the tying arm remains stationary. Only when the package has partially placed the tying means a corresponding amount around itself is the rest of the wrapping around of the cord effected by the arm. It has been found to be advantageous to obtain the rest of the wrappping-around of the cord by a swinging motion and a lateral motion of the tying arm, with suitable construction of the machine. The division of the movement of the tying arm into a swinging movement and a lateral movement produces the advantage of a tying arm of short length. Accordingly it is necessary to provide the latter also only with a brake-drive device which operates with low power requirements. As a result of the small size of the tying arm, one then obtains the further advantage of an extremely compact construction of the machine as compared with the size of the packages. The brake-drive device for the arm can advantageously be arranged on the carriage which travels transversely to the feed path. The carriage carries the tying-means drum and permits the drum to be located close to the tying arm. The drum can preferably be arranged coaxially with the axis of swing of the arm in such a manner, that the swinging motion of the arm takes place in the direction of unwinding of the cord. The development in accordance with the present invention permits a horizontal tying plane to be used. The carriage traveling on the rails can be arranged in vertically adjustable manner on vertical columns. This construction is particularly recommended for the bringing together of box-like packages arranged alongside of each other such as, for instance, boxes of beverages stacked on a pallet. The tying plane should in this case be so selected by vertical displacement of the carriage that it lies approximately in the center of the upper layer of boxes. If a chain drive is provided for the vertical displacement, an infinitely variable vertical displacement of the carriage and thus of the tying plane is possible. The vertical columns form an introduction gate together with the carriage rails. This gate can be located at a predetermined point over a feed path, for instance, in the form of a feed belt. The rear edge of the package resting on this feed belt may suitably cooperate with a photoelectric light barrier, which stops the movement of the conveyor belt and thus stops the package in the position proper for tying. Starting from this tying position, the card is fed to the fastening device by the swinging of the arm over the corners of the package, so that the fastening of the ends of the cord is effected on the side surface of the package. The cord can in this connection be placed tightly around the package by suitable tensioning elements of the fastening device. As a result of the lateral movement of the tying arm between the two phases of swing thereof, a short additional tightening path can be obtained.

In order that, in a modified embodiment of the machine, a tying of the package in a vertical plane extending in the direction of conveyance of the package may be possible, the invention proposes that the freely stretched cord extend in vertical direction and perpendicular to the horizontal package feed table along a push device which acts on the rear surface of the package.

One advantageous feature of this variant in accordance with the present invention is that the push device strikes the package approximately on the centerline of its rear surface.

It is also advantageous in accordance with the present invention for the push device, to consist of an endless closed chain which has a chain section extending in a plane parallel to the package feed table and which is equipped, equally distributed along the periphery, with downward directed push bars which come against the rear surface of the package.

Finally, it is also favorable in accordance with the present invention for the ejection device to extend over an initial partial region of the package feed table in which conveyor belts, known per se, are additionally associated with the package feed table.

In accordance with the present invention, no horizontal feed path consisting of rollers or feed belts is required or even capable of use within the region of the tying station, in order to tie the package in the aforementioned plane. The feed movement of the package is effected by the same push device as acts on the rear surface. Depending on the size or weight of the package, one or more push devices can be provided. The push device brings the package up into the position proper for tying and from there, after completion, it is conveyed by the push device to the package removal station. The push device in no way interferes with the tying process. With normal packages it is sufficient - as it has surprisingly been found - to provide only a single push device. By the push device which lies directly alongside the tying plane, the package can be acted on at approximately the center of its rear surface, so that to a far-reaching extent the danger of canting upon the feeding of the package is avoided. The advantageous development of the push device permits an economical and nevertheless effective construction. Depending on the size of the package to be tied, the section of chain traveling in a parallel plane to the package feed table can be arranged at a corresponding distance from the package feed table. Naturally, in such a case, the tying radius of the arm must be made correspondingly large. The entrainment of the package by the chain is effected in synchronism by means of the downward directed push rods. The number of them corresponds to the number of steps of the operating cycle. As a result of the uniform spacing on the periphery after each operating step, each push rod comes into the correct starting position. The specific push rod associated with the package feed point assumes such a position with respect to the package feed table that the packages can be conveniently placed on the conveyor belts provided in the initial region of the package feed table. Only when the package lies completely on said table, does the corresponding push rod enter into motion. Since the package has already been placed in motion by the conveyor belt, the corresponding push rod need merely keep the package in movement. As a result, the traveling chain is relieved of load. This is advantageous since, upon every operating step, the package which has already been tied is conveyed to the place of removal by the push rod associated with it.

The present invention will be more clearly understood from the following description, in connection with the accompanying drawings, in which FIG. 1 is a diagrammatic elevation of a machine in accordance with a first embodiment of the present invention for the horizontal tying of packages, particularly cases of beverages;

FIG. 3 is a top plan view of the machine with the freely stretched cord before insertion of the package into the machine;

FIG. 4 is a view corresponding to FIG. 3, but upon the completion of the feed movement of the package;

Figure 1:
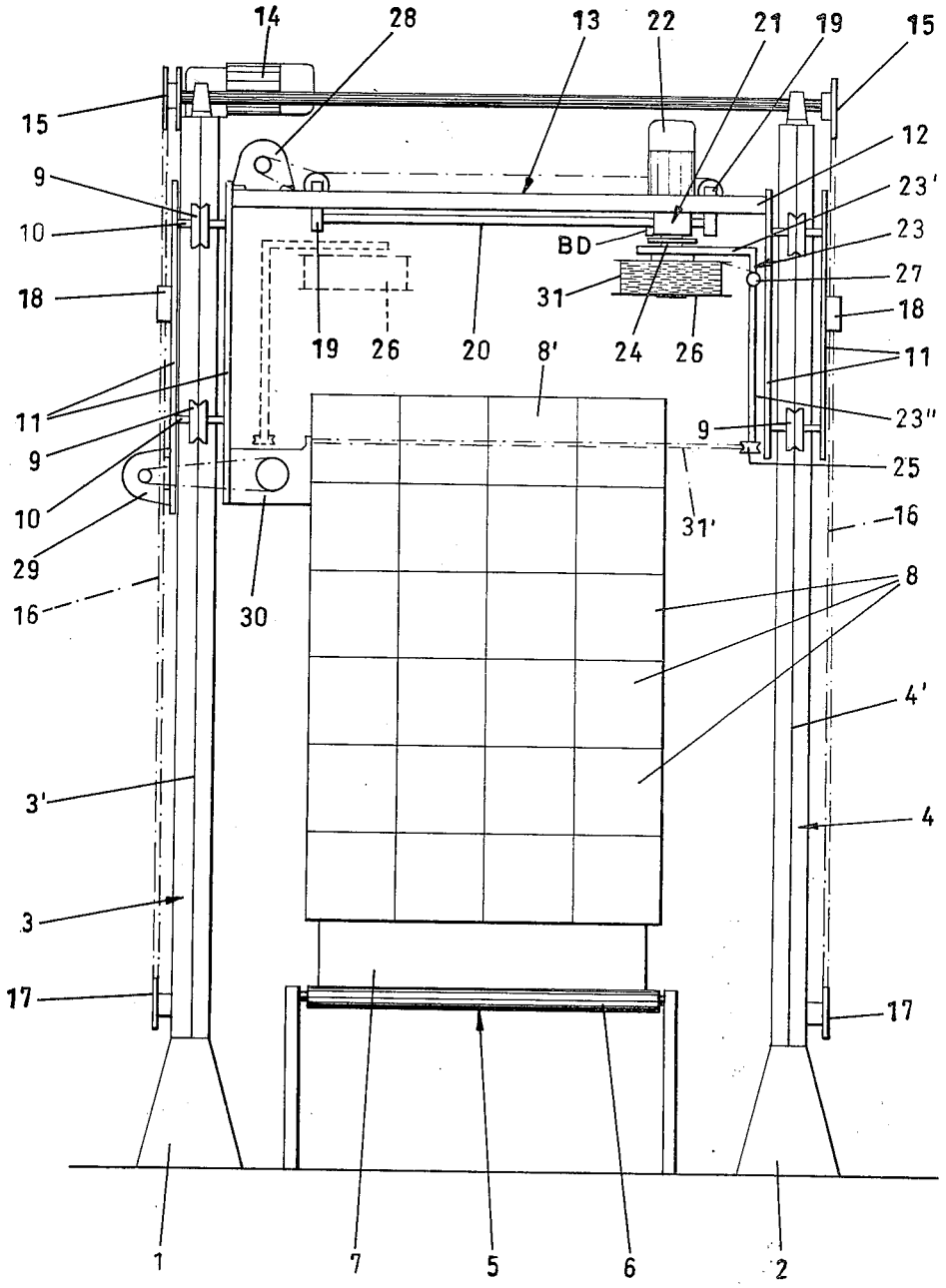
Figure 2:
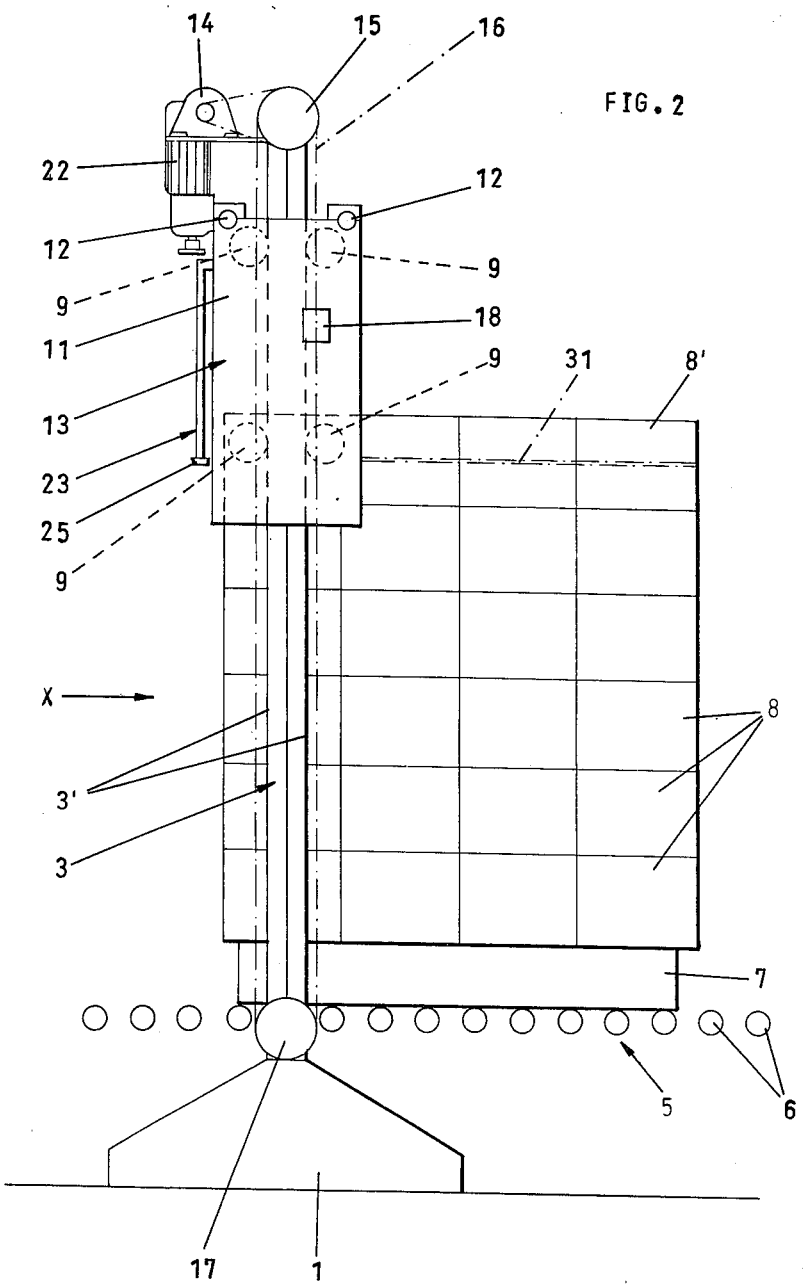
FIG. 2 is a side elevation of the machine.

FIGS. 1 – 6, the machine has vertical columns 3, 4 provided with feet 1, 2.

The colums 3, 4 of rectangular cross-section are so aligned that two opposite corner edges 3' and 4' lie in the direction of the feed movement of the feed path 5 disposed between the vertical columns 3, 4.

In the embodiment shown by way of example, the feed path 5 consists of rollers 6 forming a transport path. The rollers transport pallets 7, which in the embodiment shown, bear stacked cases of beverages 8.

On the corner edges 3', 4' of the vertical columns 3, 4 there are guided pairs of rollers 9 arranged one above the other. The shafts 10 of the pairs of rollers 9 extend from support plates 11 in such a manner that each vertical column 3, 4 has associated with it two support plates, between which the vertical column extends. The upper ends of the inner support plates 11 are connected together by two horizontally located cross members 12 which extend transverse to the direction of conveyance x, so that a support 13 is thereby formed.

In order to change the height of the support 13 there is provided a drive 14 arranged on the top of the vertical column 3. By means of this drive, the upper sprocket wheels 15 of the vertical columns are placed in rotation. They transmit their rotary movement via the chain 16 to the sprocket wheels 17, which are supported in suitable manner on the lower end of the vertical columns 3, 4. A section of the chain 16 is connected with the outer support plates 11 at the point 18, so that an infinitely variable change in height of the support 13 is possible by means of the drive 14.

The cross members 12 in their end region carry bearing plates 19. These bearing plates 19 are connected together by rails 20. On these rails 20 there moves a carriage 21 which receives the drive unit 22 for the tying arm 23. The said arm is supported for rotation around the arm swing axis 24 and is of angular shape. The horizontal leg 23' of the angle serves for the supporting of the tying arm, while the vertical leg 23'' of the angle has the guide roller 25 for the strand on its end.

Coaxially on the swing axis 24 there is supported the drum 26 carrying the tying strand with which is coordinated a brake device BD which brakes the drum 26 in the direction of removal of the strand. The tying means, removed from the drum 26, is guided over a roller 27, which is supported, in the vicinity of the drum 26, on the vertical angular leg 23'' of the arm 23.

The carriage 21 can be displaced laterally on the rails 20 via a drive device 28.

The outer support plate 11 of the vertical column 3 receives the drive motor 29 of the fastening device 30. The latter in its turn is arranged on the inner support plate 11 of the vertical column 3. This fastening device is preferably a heat-sealing or welding unit by means of which the ends of the tying means 31 consisting of a tape of synthetic material are connected together. The fastening device 30 extends into the interior of the introduction gate formed by the rails 20 and vertical columns 3, 4 and with its vertical outer surface facing the package forms a stop for the package.

In accordance with the embodiment, shown by way of example, the beverage cases 8 stacked on the pallet 7 are to be tied. For such tying it is merely necessary to tie the upper layer of cases 8'.

The corresponding adjustment of the tying plane is determined by the position of the guide roller 25 of the tying arm 23. In order to vary the position of the guide roller 25, the support 13 can be brought in infinitely variable manner by means of the drive 14 into the corresponding position.

The machine of the present invention operates as follows: the starting position is shown in FIG. 3. The tying means is held, on the one hand, by the fastening device 30 and, on the other hand, by the tying arm 23 which is in the starting position A, so that a tying chord 31' which is freely stretched transversely to the feed path 5 thereby results.

By feeding the package or cases of beverages 8, the freely stretched tying-means chord 31' is bulged into the position shown in FIG. 4. The bulging is limited in the manner, that the rear edge of the package 8' cooperates with a light barrier LB, which in its turn transmits the pulse to the drive device for the feed path 5. The braking device coordinated to the tying-means drum 26 prevents the tying-means drum from continuing to rotate.

Figure 5:
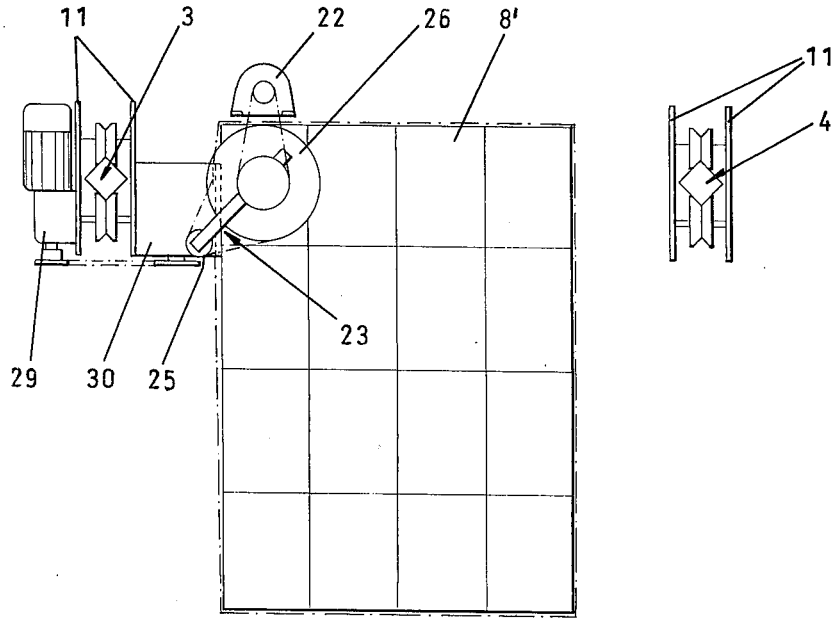
FIG. 5 is a showing corresponding to the two preceding Figures, with the strand placed completely around the package by the tying arm.
Figure 6:
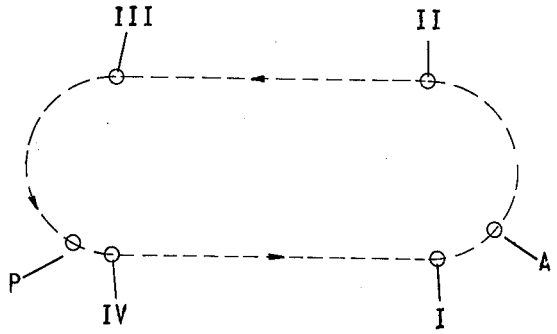
FIG. 6 is a diagrammatic showing of the path moved over by the tieing arm.

The aforementioned light barrier at the same time actuates the drive unit 22, which produces the swinging of the tying arm 23 in the direction for the unwinding of the tying means 31 from the tying-means drum 26. In this connection the tying arm swings over the one rear corner of the package into position II; (FIG. 6). Following this, the tying arm 23 carries out a lateral movement from point II to point III, caused by the drive device 28 which displaces the carriage 21 on the rails 20. When the point III is reached, the lateral movement of the tying arm 23 is changed into a swinging movement up to point P. In this way the tying means has been wrapped completely around the package, so that the fastening device can connect the ends of the tying means with each other (FIG. 5). After the completion of the fastening, the tying arm swings through the remaining angle into position IV and then carries out a lateral movement up to point I and from there a slight swinging movement to the starting position A.

As can be noted from FIG. 5, the connecting of the ends of the tying means takes place on the side face of the package.

Due to the lateral and swinging movements of the tying arm 23, a small size of the machine relative to the packages can be obtained.

As shown particularly in FIG. 4, the length of the packages is unimportant, since the bulge can be as long as desired.

The machine in accordance with the second embodiment, shown in FIGS. 7 – 12, has the box-shaped underframe 32. Columns 33 arranged in pairs opposite each other and directed vertically protrude beyond the underframe on its longitudinal sides. Each pair of these columns 33 is connected by a horizontal yoke 34. In this way the columns 33 together with the associated yokes 34 form a U which is open towards the underframe 32.

The top of the underframe serves as package feed table 35. Conveyor belts 36 extend alongside each other in the initial portion of the package feed table. These belts are supported by rollers 37, 38, one of which is placed in rotation by a drive (not shown).

In a portion of the feed table, arranged behind the conveyor belts 36, a straightening station is provided. It consists of guide plates 39, arranged opposite each other. These guide plates can be suitably displaced in the direction indicated by the double-ended arrows. The discharge end of the guide plates 39 supports two flaps 39', which are swingable in the direction indicated by the arrow y.

Behind this straightening station there is a supplementary table 40, which lies on the same plane as the package feed table 35. This table 40 is borne by a vertically directed section 41 of the tying-arm swing shaft 34, but in such a manner, that the supplementary table 40 is non-rotatable.

On the swing shaft 24 of the tying arm there is supported the tying- means drum 26 which has a brake (not shown) coordinated thereto, which brakes the tying-means drum 26 in the direction of withdrawal of the tying means. The tying-means 31 which has been withdrawn from the tying-means drum 26 is conducted over rollers (not shown) to the end guide roller 25 which is seated on the one angle leg of the tying arm 23*a*. The end of the tying means which is conducted around this guide roller 25 is held in this connection by the fastening device 30. This fastening device is preferably a heat-sealing unit by means of which the ends of the tying means 31 which consists of plastic tape are connected together. The fastening device 30 is located below the feed table 35.

The supplementary table 40 and the feed table 35 leave a U-shaped slot 42 between them, so that the tying arm 23*a* can carry out a complete rotation.

The tying means drum 26 as well as swing arm 23*a*, supplementary table 40 and fastening device 30 are seated in a swingable part 43 of the underframe 32. This part 43 can be supported on the hinge shaft 44, in order to be able conveniently to effect any repairs or adjustment work.

Figure 8:
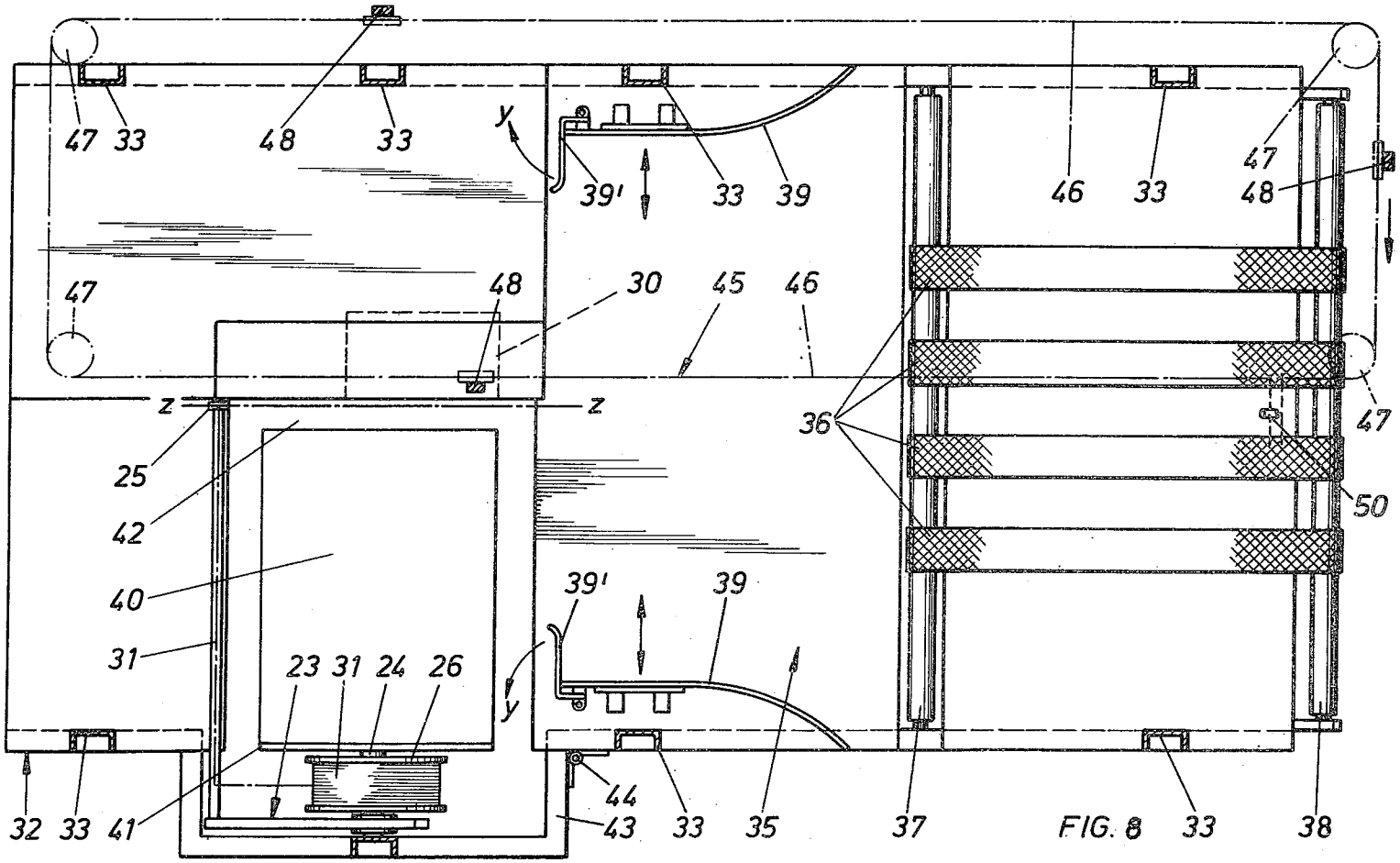
FIG. 8 is a horizontal section through the machine below the rotating chain.

The tying plane is designated *z—z* (FIG. 8). This means, that it lies in a vertical plane extending vertical to the direction *x* of the package feed.

The push device 45 extends alongside the tying plane *z—z*. It consists of an endless closed chain 46, which rotates in a plane parallel to the package feed table 35. The chain 46 is place over sprocket wheels 47 supported by the columns 33 in such a manner, that the chain 46 forms a rectangle extending over the length of the feed table 35. In the initial portion of the package feed table, the chain 46 extends beyond the table. Push rods 48, which are directed downward and terminate just in front of the feed table 35 are arranged spaced equally apart over the chain. In the embodiment, shown by way of example, three push rods 48 are provided. This means, that one working-cycle step of the chain corresponds to one-third of its circumferential length.

Figure 7:
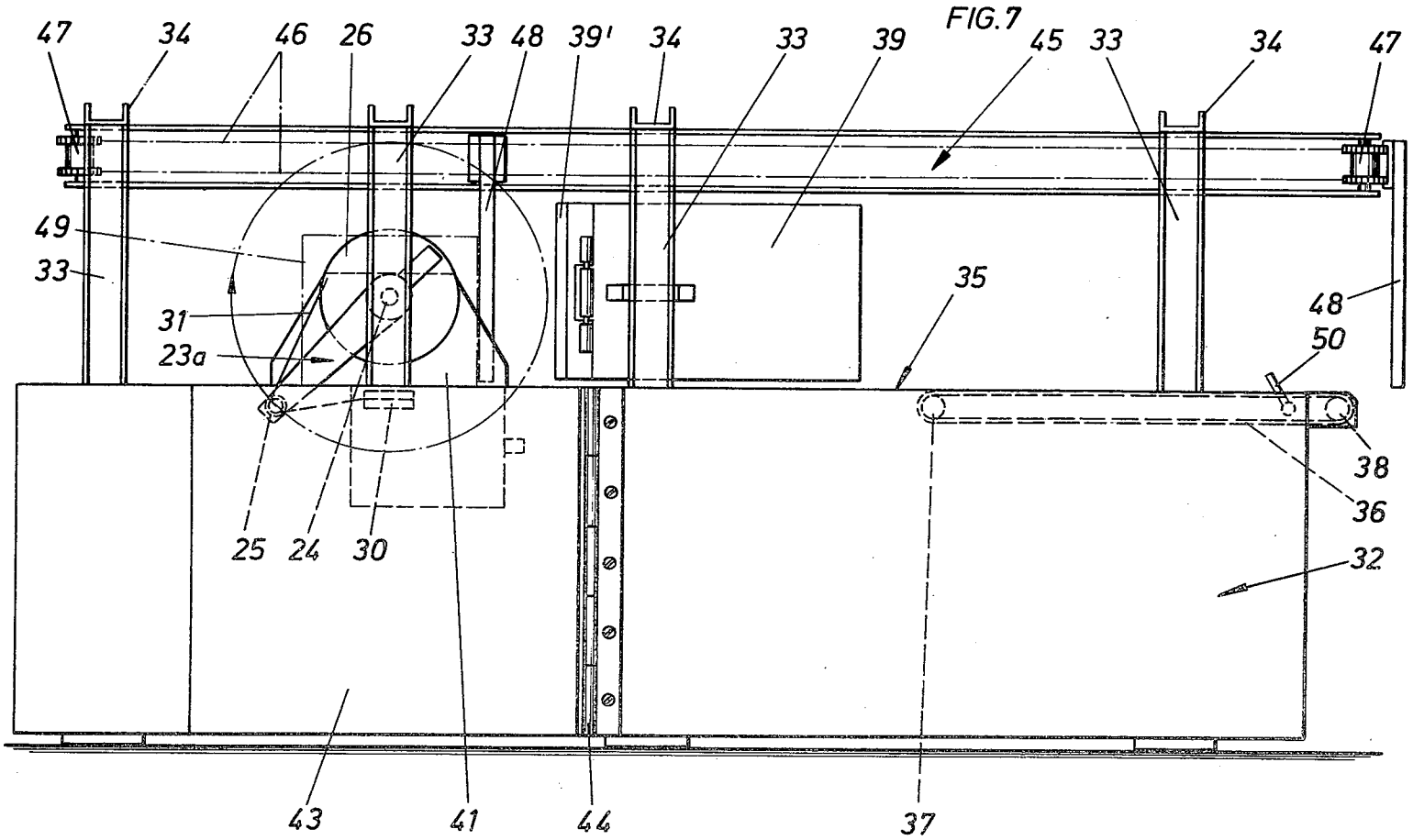
FIG. 7 is a side elevation of the machine in accordance with the second embodiment of the present invention.
Figure 9:
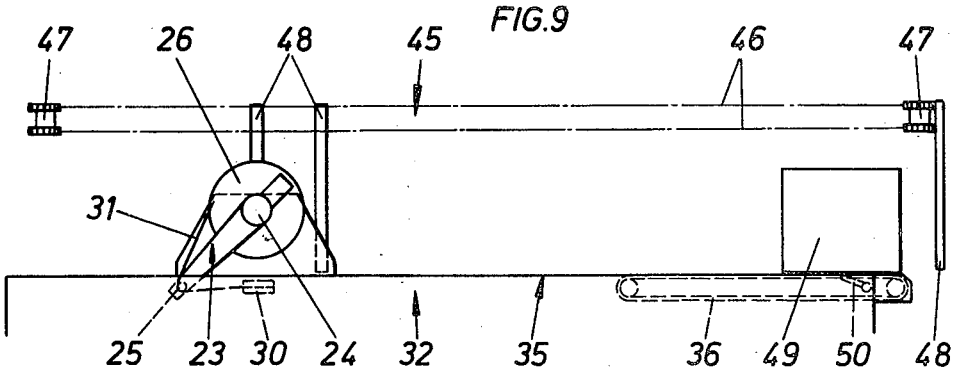
FIGS. 9 to 12 disclose diagrammatically the cyclic operating steps of the machine.
Figure 10:
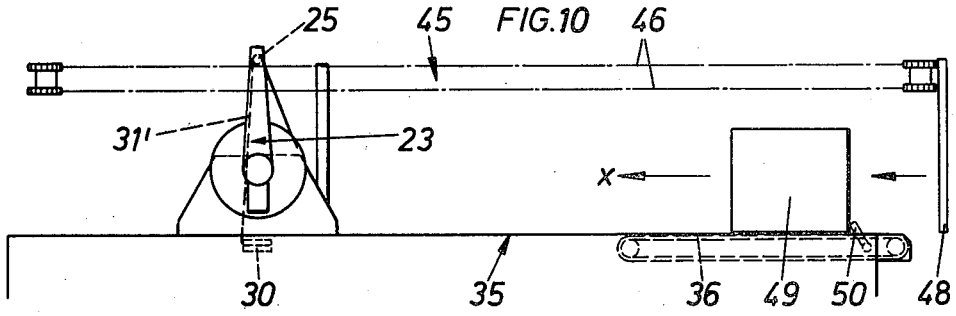
Figure 11:
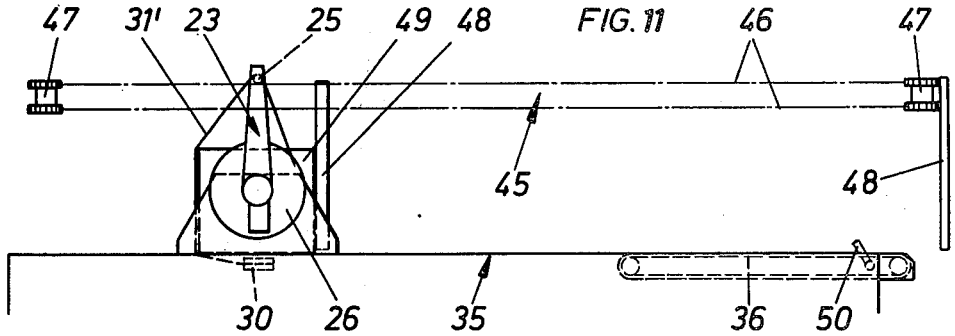
Figure 12:
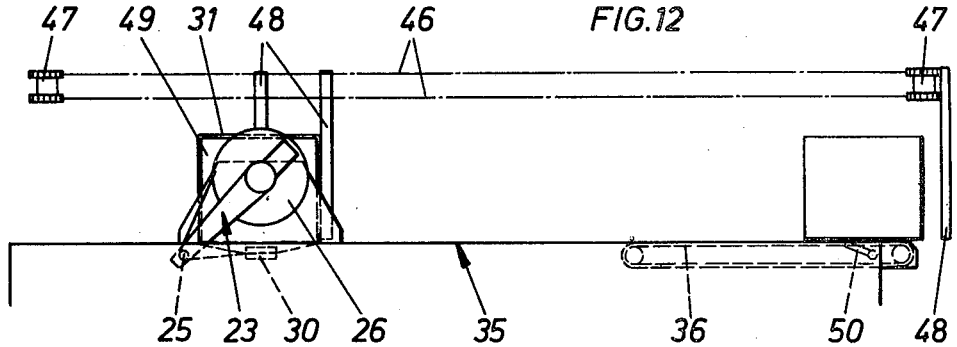

The following manner of operation results: the starting position of the machine is shown in FIGS. 7 to 9. The push rod 48 which extends in the initial region of the package feed table 35 lies on the side of the feed table. The package 49 can thus be placed on the conveyor belts 36. When the package is placed on the belts, a feeler finger 50 adjacent the roller 38 is swung away. As soon as the package 49, transported by the conveyor belts 36, releases the feeler finger 50, so that it can swing back, the tying arm 23 travels into the position shown in FIG. 10. As a result, a freely stretched tying-means chord 31' is present between the fastening device 30 and the guide roller 25. The chain 46 enters into motion simultaneously with the upward swinging of the tying arm 23.

The push rod 48 lying on the entrance side of the feed table carries the package 49, which has already been conveyed by the conveyor belts 36 along with it and brings it to the straightening station. Since the package 49 is acted on by the push rod 48 on the center line of its rear surface, a further conveying of the package without canting results. The push rod 48 then carries the package along into the position shown in FIG. 11, the package 49 partially bulging the freely stretched tying-means chord 31'. Upon reaching the position shown in FIG. 11, the tying arm enters into operation, conducts the tying means completely around the package 49 but remains with the guide roller 25 below the feed table 35. In this position of the tying arm 23, the fastening device 30 connects the ends of the tying means together. During this process, another package can already be placed on the conveyor belts 36. Upon the following step of the working cycle of the chain, the completely tied pack 49 is thus simultaneously brought to the point of discharge from the machine, while the newly introduced package is brought to the tying-means station.

Instead of the horizontally rotating chain 46, a vertical direction thereof could also be selected. This means that in such case the push rods 48 would rotate in a vertical plane.

While I have disclosed several embodiments of the present invention, it is to be understood that these embodiments are given by example only and not in a limiting sense.

I claim:

1. A machine for tying packages comprising:

means defining a feed path for a package;

rails extending transversely to said feed path and extending over its width;

a carriage displaceable on said rails across said feed path;

a tying arm mounted on said carriage for placing an elongated tying element around said package by forming a bulge in said element freely stretching transversely to said feed path for engagement by the package upon the feeding thereof along said path, said arm thereafter displacing said element around the remainder of the package; and a fastening device for tying said element after it has been passed around said package by said arm.

2. The machine defined in claim 1, further comprising a supply drum on said carriage for delivering said element to said arm.

3. The machine defined in claim 2 wherein said arm is swingable on said carriage about an axis and said drum has an axis of swing centered on the axis of said arm.

4. The machine defined in claim 2, further comprising vertical columns supporting said rails and said fastening device for adjustment in a vertical direction.

5. The machine defined in claim 2, further comprising means for rotating said drum in a sense to enable withdrawal of said element therefrom, and means for braking the rotation of said drum in said sense.

6. The machine defined in claim 2, further comprising vertical columns carrying said rails and said fastening device, said columns defining with said rails a gate through which said package is passed.

7. The machine defined in claim 2 wherein said arm has a swing adapted to extend over the rear corners of said package.

* * * * *